US007143450B2

(12) United States Patent
Green, III

(10) Patent No.: US 7,143,450 B2
(45) Date of Patent: Dec. 5, 2006

(54) DUAL ACCESS CARGO SYSTEM FOR OUTERWEAR

(76) Inventor: Jarvis Green, III, 40 Wyntre Brooke Dr., York, PA (US) 17403

( * ) Notice: Subject to any disclaimer, the term of this patent is extended or adjusted under 35 U.S.C. 154(b) by 142 days.

(21) Appl. No.: 10/800,521

(22) Filed: Mar. 15, 2004

(65) Prior Publication Data

US 2005/0198723 A1 Sep. 15, 2005

(51) Int. Cl.
*A41D 15/04* (2006.01)

(52) U.S. Cl. ..... 2/94; 2/86; 2/89

(58) Field of Classification Search ..... 2/69, 2/69.5, 84–89, 94, 108, 209.11, 72; 224/557, 224/664

See application file for complete search history.

(56) References Cited

U.S. PATENT DOCUMENTS 2,165,348 A * 7/1939 Daiber ..... 2/94
2,919,443 A 1/1960 Kashiyama
4,347,629 A 9/1982 Itoi
4,389,735 A * 6/1983 McLaughlin ..... 2/94
4,404,687 A * 9/1983 Hager ..... 2/94
4,404,689 A * 9/1983 DeWan ..... 2/247
4,476,587 A * 10/1984 Itoi ..... 2/94
4,502,154 A 3/1985 Itoi
4,502,155 A * 3/1985 Itoi ..... 2/115
4,563,777 A * 1/1986 Park ..... 2/108
4,689,831 A * 9/1987 Greenberger et al. ..... 2/93
4,700,409 A * 10/1987 De Lott ..... 2/94
5,123,117 A * 6/1992 Prendergast ..... 2/108
5,165,111 A * 11/1992 Lieberman ..... 2/94
5,367,713 A * 11/1994 McCallum ..... 2/209.12
5,407,112 A * 4/1995 Christodoulou et al. .... 224/153
5,526,969 A * 6/1996 Greenberger ..... 224/153
5,564,125 A 10/1996 Waldman et al.
5,699,560 A * 12/1997 Greenberg ..... 2/94
5,794,264 A * 8/1998 Yuen ..... 2/93
5,815,833 A * 10/1998 Kuo ..... 2/69.5
5,860,164 A * 1/1999 Johnson ..... 2/94
5,871,132 A * 2/1999 Hargreaves ..... 224/576
6,134,712 A * 10/2000 Spector ..... 2/94
6,167,569 B1 * 1/2001 Conner, IV ..... 2/209.11
D439,029 S 3/2001 Goldman
6,230,331 B1 * 5/2001 Aguilar et al. ..... 2/209.11
6,339,845 B1 1/2002 Burns et al.
6,405,377 B1 6/2002 Davis
6,564,388 B1 * 5/2003 Poston ..... 2/86

* cited by examiner

*Primary Examiner*—Alissa L. Hoey
(74) *Attorney, Agent, or Firm*—McNees Wallace & Nurick LLC

(57) ABSTRACT

A convertible garment, such as from a garment to a fanny pack, having a first material portion affixed to the outside surface of the garment over an opening formed in the garment defining a first chamber for holding an object therein, including a first zipper providing access through the first material portion. A second zipper is located in the opening in the garment that is under the first material portion. A second material portion having a third zipper therein is affixed to the inside surface of the garment defining a second chamber for holding an object therein. When the second zipper is open, the first and second chambers are in communication with each other, so that an object placed in the first chamber when worn as a garment can be accessed after the garment has been converted to a fanny pack by opening the second zipper.

25 Claims, 8 Drawing Sheets

DUAL ACCESS CARGO SYSTEM FOR OUTERWEAR

FIELD OF THE INVENTION

The present invention relates generally to cargo systems for outerwear, and more particularly to a dual access cargo system for convertible outerwear.

BACKGROUND OF THE INVENTION

There is demand in the clothing and apparel industry for outerwear that can be adapted based on changing environmental conditions. For example, outerwear, such as a jacket or a sweatshirt, may be converted to a duffel or more preferably, to a duffel that can be strapped to a wearer's waist. This strapped duffle is commonly referred to as a "fanny pack."

Typically, a convertible jacket configuration includes a first pouch or chamber which is affixed to the outer surface of the jacket that may be employed to hold or to secure an object therein when worn as a jacket. A second pouch or chamber that is affixed to the inner surface of the jacket is turned inside-out to envelope the jacket, converting the jacket to a fanny pack. While this configuration offers convenience for the wearer, access to an object placed in the outer pocket when worn as a jacket, is not easily accessible after the jacket has been converted to a fanny pack. This inaccessibility is primarily due to the first pouch or chamber being placed or inserted within the second pouch or chamber during this conversion. Therefore, to retrieve the item in the outer pocket, the fanny pack must often be converted to a jacket in order to access the first pouch or chamber, and then converted back to a fanny pack, which is time-consuming and inconvenient.

There is a need in the art for convenient access to an object placed in an outer pouch or chamber of a garment after the garment has been converted to a fanny pack.

SUMMARY OF THE INVENTION

The present invention relates to a convertible garment, comprising a garment portion for being worn by a user and having a shell with an outside surface and an inside surface, the shell including a shell opening providing access through the shell, the shell having an access device for selectively opening and closing the shell opening. At least one first material portion is affixed to the outside surface of the shell and disposed over the shell opening, the shell and the at least one first material portion defining a first chamber for holding an object therein. The first chamber includes a first chamber opening providing access through the at least one first material portion, the first chamber having a first access device for selectively closing and opening the first chamber opening, and the shell opening providing access to the first chamber through the shell. A second material portion is affixed to the inside surface of the shell and disposed over the shell opening, the shell and second material portion defining a second chamber sized to enclose at least the garment portion. The second chamber includes a second chamber opening providing access through the second material portion, the second chamber having a second access device for selectively opening and closing the second chamber opening. Wherein upon turning the second chamber inside out and receiving the garment portion within the second chamber to form a duffel, an object enclosed in the first chamber is accessible from exterior of the duffel.

The present invention further relates to a convertible garment, comprising a garment portion for being worn by a user and having a shell, the shell including a shell opening providing access through the shell, the shell having an access device for selectively opening and closing the shell opening. A first material portion is affixed to a surface of the shell and disposed over the opening, the shell and first material portion defining a first chamber for holding an object therein. The first chamber includes a first chamber opening providing access through the first material portion, the first chamber having a first access device for selectively closing and opening the first chamber opening, and the shell opening providing access to the first chamber through the shell. A second material portion is affixed at least partially disposed over the first material portion and disposed over the first opening in the first material portion. The first material portion and the second material portion define a second chamber sized to enclose at least the garment portion, the second chamber including a second chamber opening providing access through the second material portion having a second access device for selectively opening and closing the second chamber opening. Wherein upon turning the second chamber outside out and receiving the garment portion within the second chamber to form a duffel, an object enclosed in the first chamber is accessible from exterior of the duffel.

The present invention further relates to a convertible flexible container, comprising a container portion for carrying an object therein and having a shell with an outside surface and an inside surface. The shell includes a shell opening providing access through the shell, the shell opening having an access device for selectively opening and closing the shell opening. A first material portion is affixed to the outside surface of the shell and disposed over the opening, the shell and first material portion defining a first chamber for holding an object therein. The first chamber includes a first chamber opening providing access through the first material portion having a first access device for selectively closing and opening the first chamber opening and the shell opening providing access to the first chamber through the shell. A second material portion is affixed to the inside surface of the shell disposed over the shell opening, the shell and second material portion defining a second chamber sized to enclose at least the garment portion. The second chamber includes a second chamber opening providing access through the second material portion having a second access device for selectively opening and closing the second chamber opening. Wherein upon turning the second chamber inside out and receiving the container portion within the second chamber to form a duffel, an object enclosed in the first chamber is accessible from exterior of the duffel.

The present invention further relates to a method for incorporating a dual access cargo system for use with a convertible garment portion, the steps comprising providing a garment portion for being worn by a user and having a shell with an outside surface and an inside surface; forming an opening in the shell to provide access through the shell; affixing an access device to the shell opening for selectively opening and closing the shell opening; affixing a first material portion to the inside surface of the shell and disposed over the shell opening, the shell and first material portion defining a first chamber for holding an object therein, the first chamber including a first chamber opening providing access through the first material portion having a first access device for selectively closing and opening the first chamber opening, the shell opening providing access to the first chamber through the shell; and affixing a second material portion at least partially disposed over the first material portion and disposed over the first opening in the first material portion, the first material portion and second material portion defining a second chamber sized to enclose at least the garment portion, the second chamber including a second chamber opening providing access through the second material portion having a second access device for selectively opening and closing the second chamber opening, wherein upon turning the second chamber outside out and receiving the garment portion within the second chamber to form a duffel, the object enclosed in the first chamber is accessible from exterior of the duffel.

Among the principal advantages of the present invention is the provision of an access device permitting convenient access to an object placed in an outer pouch or compartment of a garment after the garment has been converted to a fanny pack without requiring reconverting the fanny pack back to a garment.

A further advantage of the present invention is the provision of an access device, which permits convenient access to an object placed in a pouch or compartment of a fanny pack after the fanny pack has been converted to a garment, without requiring reconverting the garment to a fanny pack.

A still further advantage of the present invention is the provision of an access device, which permits convenient access to an object placed in a pouch or compartment of a large container, after the container has been converted to a smaller container.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
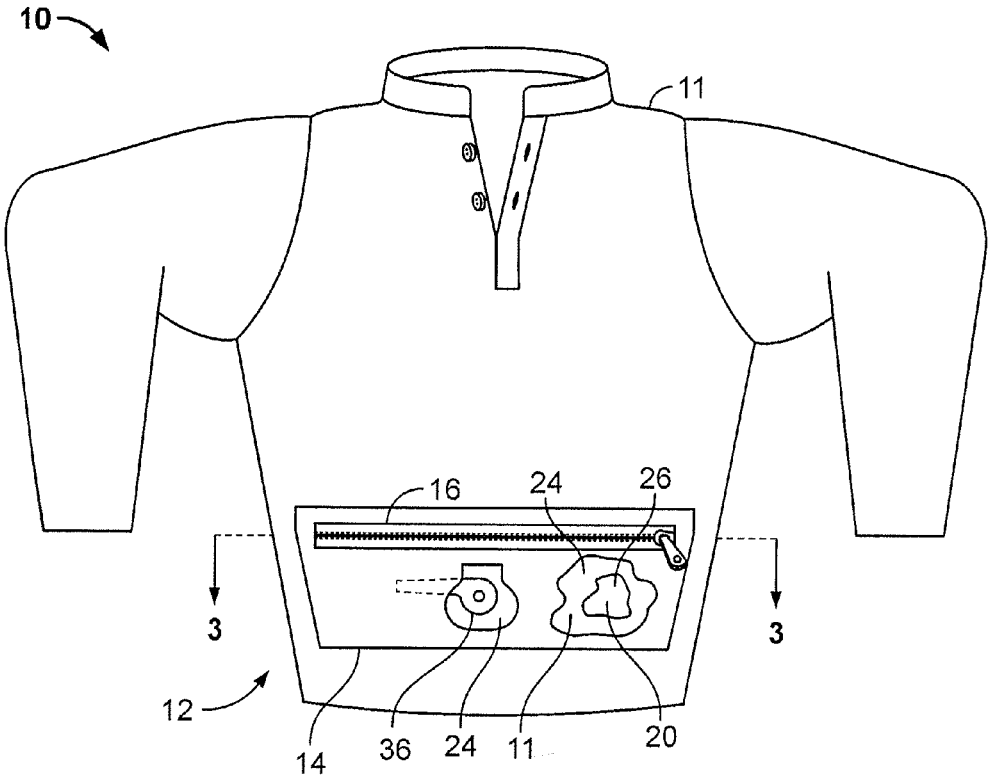
FIG. 1 is an elevation view of a garment having a dual access cargo system of the present invention.
Figure 2:
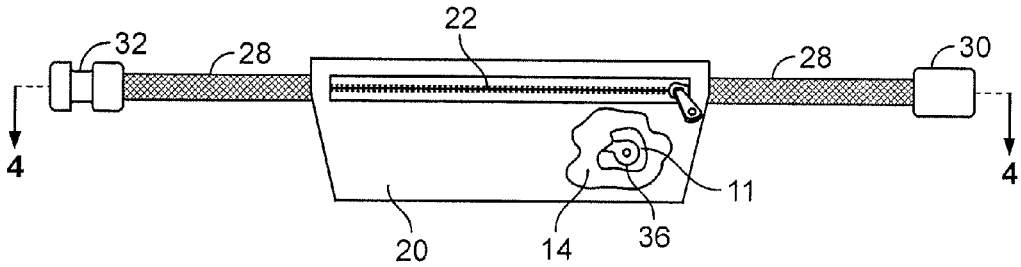
FIG. 2 is an elevation view of the garment of FIG. 1 converted to a fanny pack having the dual access cargo system of the present invention.
Figure 3:
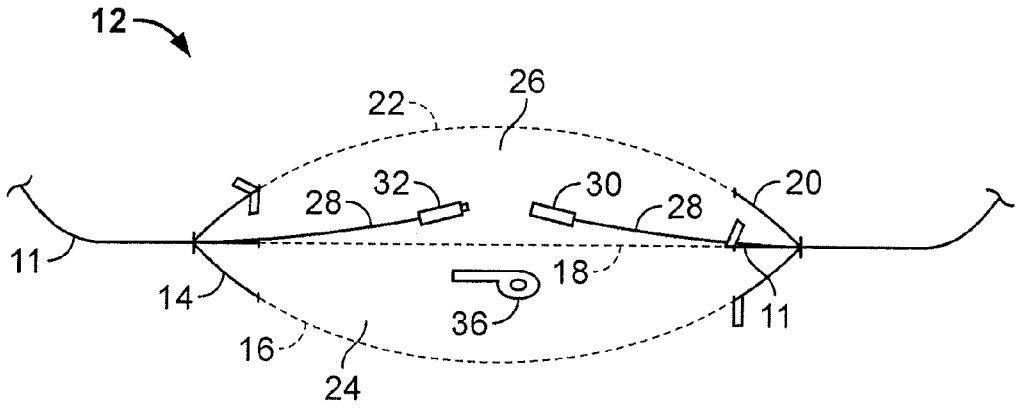
FIG. 3 is a cross-section of the garment taken along line 3—3 from FIG. 1.

Referring to FIGS. 1–4, a dual access cargo system 12 is depicted. Typically, a garment 10, such as a shirt or sweatshirt or any other item of outerwear, includes a shell 11 and a first material portion 14 affixed to the outer surface of shell 11. A first access device 16, such as a zipper, series of buttons or Velcro® strips, which is a registered trademark of Velcro Industries B.V., LLC of Netherland Antilles, is affixed to the first material portion 14 to permit selective access through an opening in the first material portion 14. First material portion 14 and the outer surface of shell 11 define a first chamber 24 for securing an object 36 therein. Preferably within the peripheral confines of first material portion 14, a second access device 18 is affixed to shell 11 for permitting selective access to first chamber 24 through an opening in the shell 11. Stated another way, second access device 18 must be at least partially covered by first material portion 14 so that first chamber 24 can be accessed through shell 11 and more preferably, first material portion 14 entirely covers second access device 18. Affixed to the inside surface of shell 11 opposite first material portion 14 is a second material portion 20. Second material portion 20 and the inner surface of shell 11 define a second chamber 26 that is configured or stored inside the shell 11 when the shell 11 is worn or used as a garment, also referred to herein as a garment mode. Second chamber 26 is sized to at least enclose the entire garment as is discussed in further detail below. A third access device 22 is affixed to second material portion 20 for permitting selective access to second chamber 26 through an opening in second material portion 20. Additionally, selective access to second chamber 26 is provided through an opening in second access device 18 through shell 11. Second access device 18 must be at least partially covered by second material portion 20 so that second chamber 26 can be accessed through shell 11, and more preferably, second material portion 20 entirely covers second access device 18. When the garment has been converted to a duffel or fanny pack as discussed below, the fanny pack configuration is referred to as a fanny pack mode. Although a duffel does not require a carrying means, as used herein for purposes of the invention, a duffel is interchangeably referred to as a fanny pack.

Importantly, when first access device 16, second access device 18, and third access device 22 are each placed in an open position, not only are first and second chambers 24, 26 in communication with each other and accessible from one another, but an area exterior of the outer surface of shell 11 of garment 10 is in communication with, and can be accessed from, an area interior of the inner surface of shell 11. Stated another way, a wearer of garment 10, such as a jacket, when in garment mode, could extend his fingers through the opened first access device 16 in the first material portion 14, the shell 11 as provided by second access device 18, and through the second material portion 20 through the third access device 22 to directly touch the wearer through the garment.

A primary aspect of the present invention is to permit convenient access to an object 36, such as a key, wallet or other item, that is placed in first chamber 24 by selectively opening and closing first access device 16 when in garment mode, and later permitting easy access to the object 36 secured in first chamber 24 (FIG. 4) by selectively opening the second access device 18 when in fanny pack mode.

Figure 4:
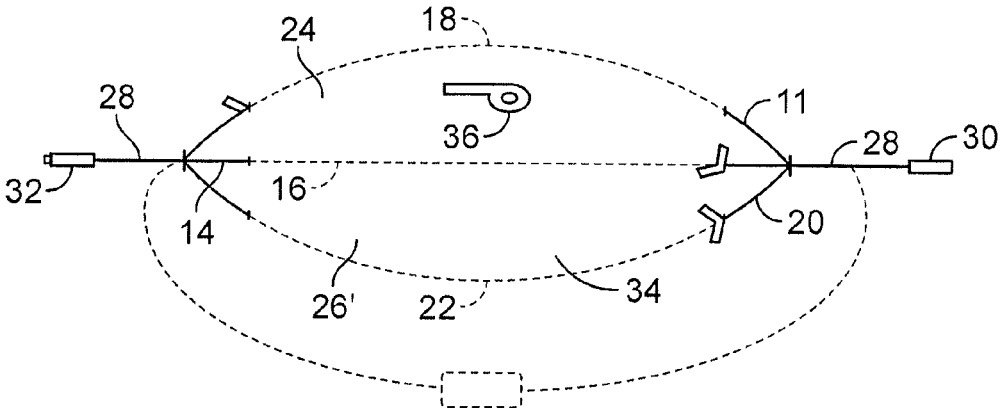
FIG. 4 is a cross-section of the fanny pack taken along line 4—4 of FIG. 2.
Figure 5:
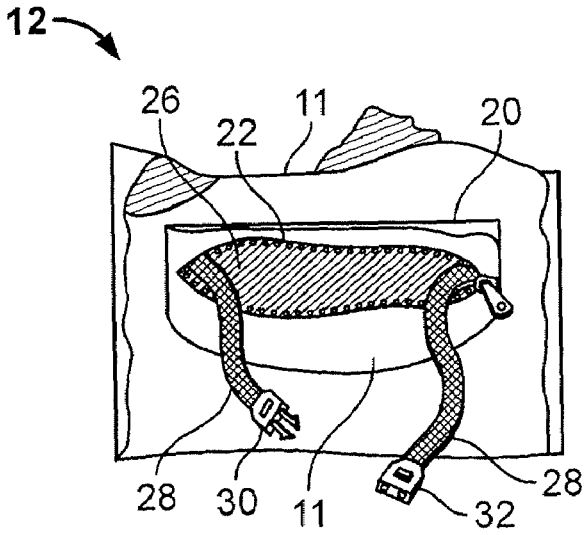
FIGS. 5–9 depict incremental, successive steps occurring for converting a garment to a fanny pack that is usable with the dual access cargo system of the present invention.
Figure 6:
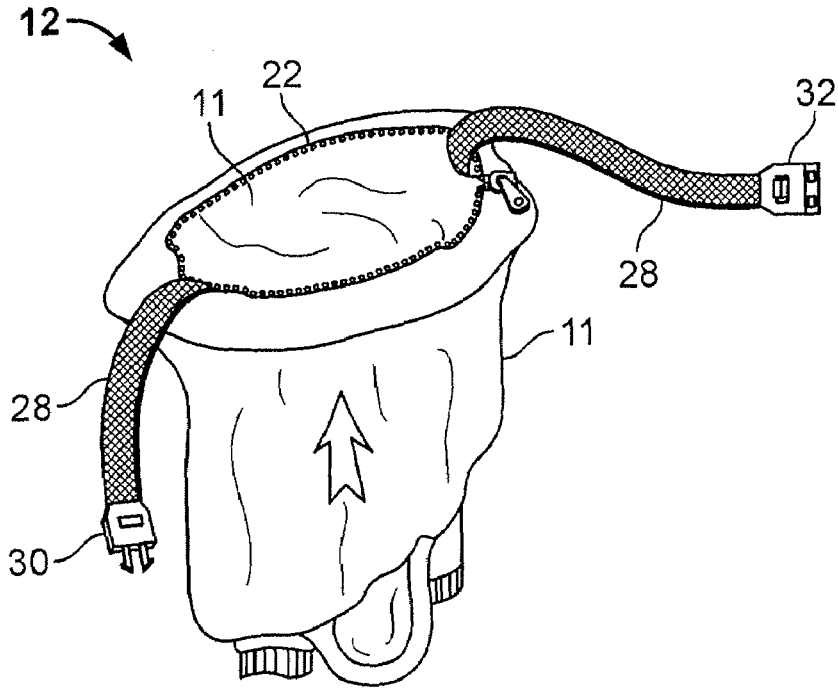
Figure 7:
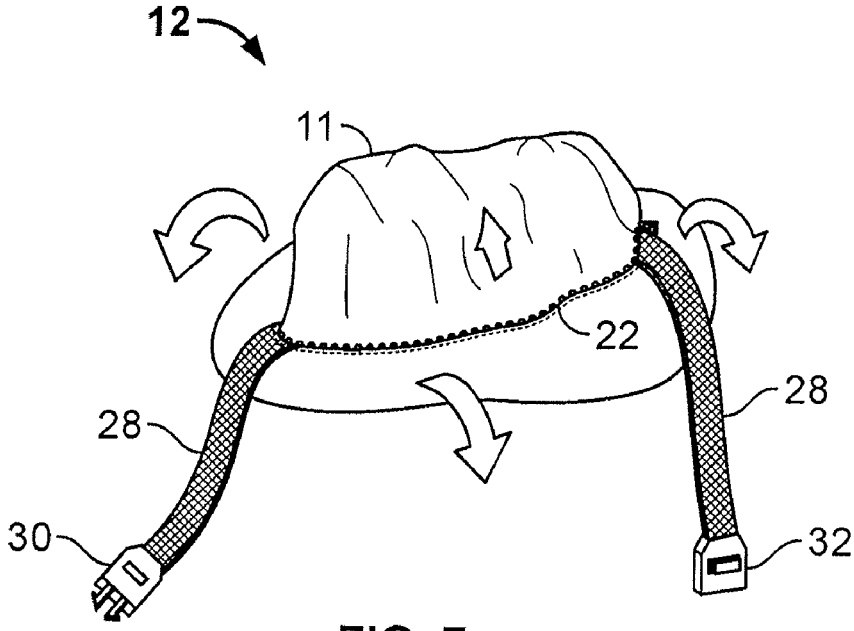
Figure 8:
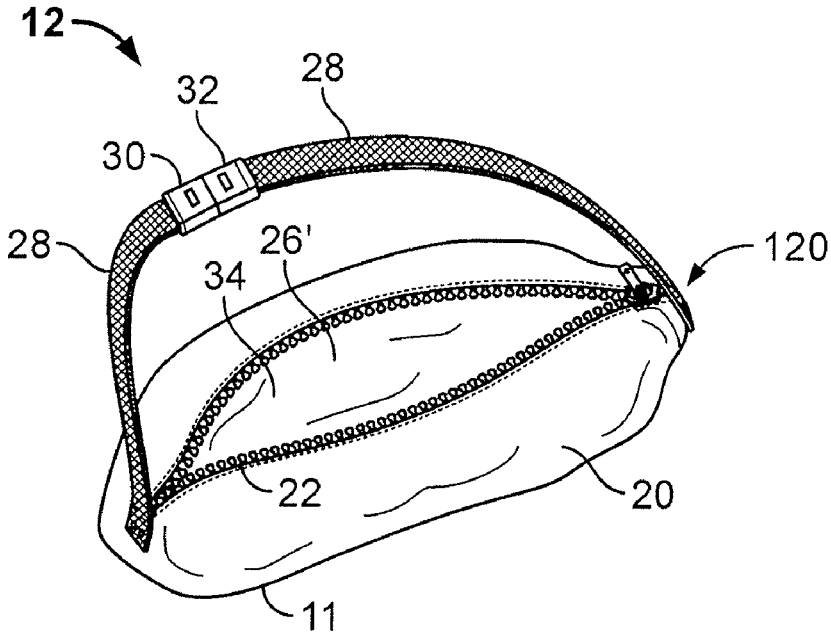
Figure 9:
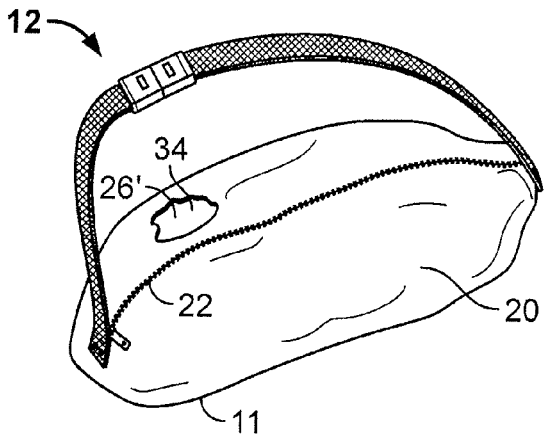
Figure 10:
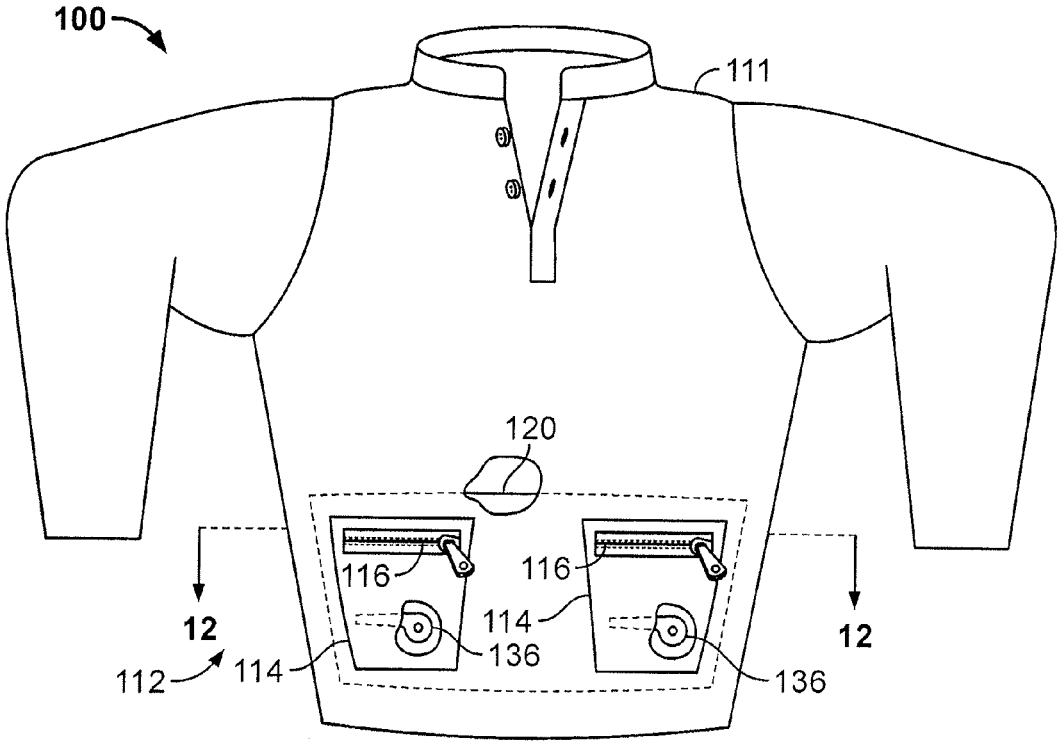
FIG. 10 is an elevation view of a garment having an alternate embodiment of the dual access cargo system of the present invention.
Figure 11:
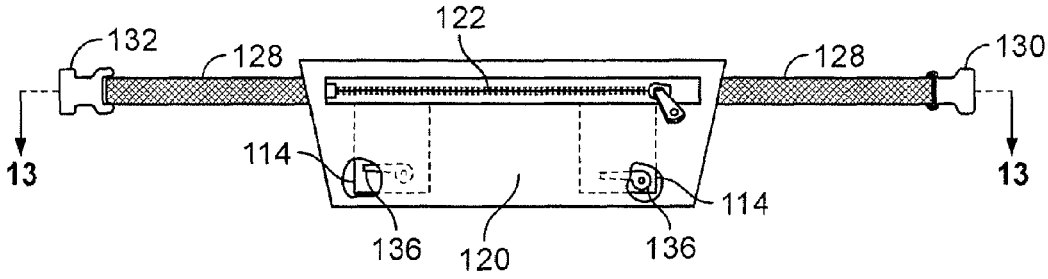
FIG. 11 is an elevation view of the garment of FIG. 10 converted to a fanny pack having the dual access cargo system of the present invention.
Figure 12:
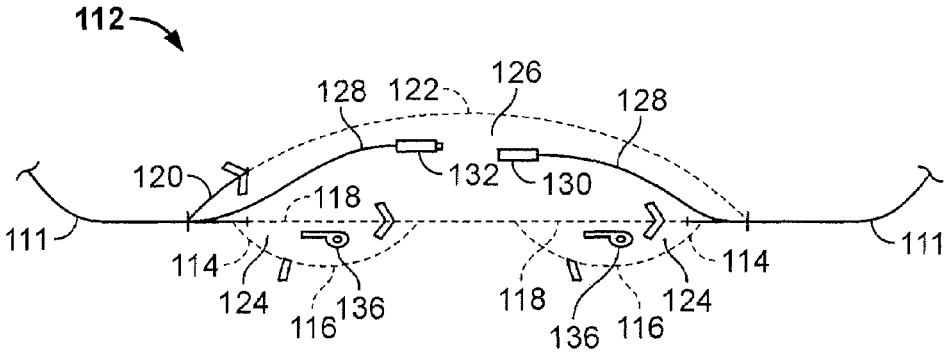
FIG. 12 is a cross-section of the garment taken along line 12—12 of FIG. 10.
Figure 13:
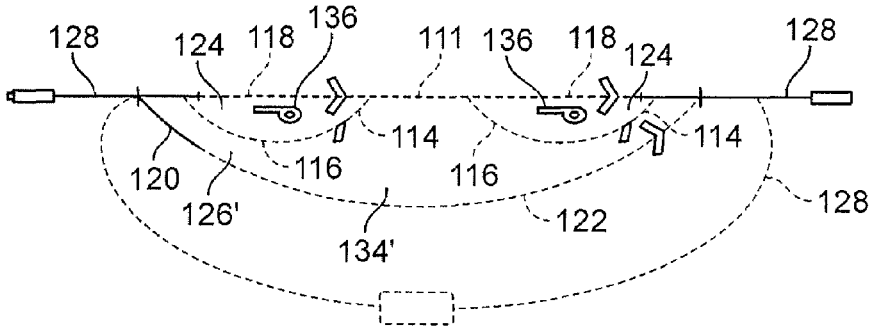
FIG. 13 is a cross-section of the fanny pack taken along line 13—13 of FIG. 11.

Referring to FIGS. 1–9, to convert from garment mode to fanny pack mode, third access device 22 is actuated to an open position (FIG. 5) freeing an end of a strap half 28 that is preferably secured by sewing, adhesive or fastener adjacent one end of second material portion 20 extending to a first connector half 30, and an end of a second strap half 28 preferably secured by sewing, adhesive or fastener adjacent an opposite end of second material portion 20 extending to a second connector half 32. As shown in FIGS. 6–7, shell 11 of garment 10 is directed toward the open third access device 22 to invert the interior surface of the second chamber 26. As further shown in FIGS. 8–9, once the entire shell 11 has been directed through the opening defined by third access device 22, the inverted interior surface of the second chamber 26, in effect, has surrounded and enclosed the now compressed garment 34. Upon actuating third access device 22 to a closed position, the compressed garment 34 is totally enclosed within an inverted second chamber 26'. Inverted second chamber 26' differs from second chamber 26 in that the exterior surface of second chamber 26' is the interior surface of second chamber 26. Therefore, an object or key 36 placed in first chamber 24 when the garment 10 is in garment mode, by selectively actuating first access device 16, is easily accessible from first chamber 24, when the garment is in fanny pack mode and worn as shown in FIG. 4, by actuating second access device 18 to an open position. Second access device 18 is immediately accessible when the wearer's torso is encircled with strap halves 28 and connecting connector halves 30, 32.

Although FIGS. 1–9 disclose second chamber 26 being sized to at least enclose the entire garment 10, if first chamber 24 is similarly sized and the ends of strap halves 28 are moved from second chamber 26 to first chamber 24, shell 11 of garment 10 may also be directed through first zipper 16 to convert from garment mode to fanny pack mode.

Referring to FIG. 10–13, an alternate embodiment of cargo system 112 has a plurality of first material portions 114 that are affixed to the outer surface of shell 111 and each of which are selectively opened by a respective first access device 116 to access a corresponding chamber as previously discussed. Each first material portion 114 and the exterior surface of the shell 111 define a first chamber 124 for securing an object 136 therein. Affixed to the inner surface of shell 111 is a second material portion 120 that is both sufficiently sized and positioned so that at least first access devices 116 are positioned within the peripheral confines of second material portion 120. Second material portion 120 and interior surface of shell 111 define a second chamber 126 that is configured or stored inside the shell 111 in the garment mode. In addition, within second chamber 126 is an end of a strap half 128 which is secured by sewing, adhesive or fastener adjacent one end of second chamber 126 that extends to a first connector half 130, and an end of a strap half 128 which is secured by sewing, adhesive or fastener adjacent an opposite end of second chamber 126, that extends to a second connector half 132 for securing about a wearer's torso.

The conversion from garment mode to fanny pack mode is as previously discussed, wherein the shell 111 is directed through the opened third zipper 122 so that the compressed garment 134 is enclosed within an inverted second chamber 126', which is second chamber 126 turned inside out. Keys or objects 136 placed in first chambers 124, when worn as a garment, are accessed by respective first access devices 116, and when worn as a fanny pack, are accessed by actuating second access devices 118. Alternately, second zippers 118 may be a single, contiguous zipper, if desired. However, in garment mode, portions of a contiguous second zipper 118 may be visible between adjacent first material portions 114.

It is appreciated that a plurality of first material portions 114 and associated components as discussed may be employed with other garment embodiments, such as discussed below, although its application is not limited to a plurality of material portions applied to an outer surface of a garment, but may also be applied to an inner surface of the garment.

Figure 14:
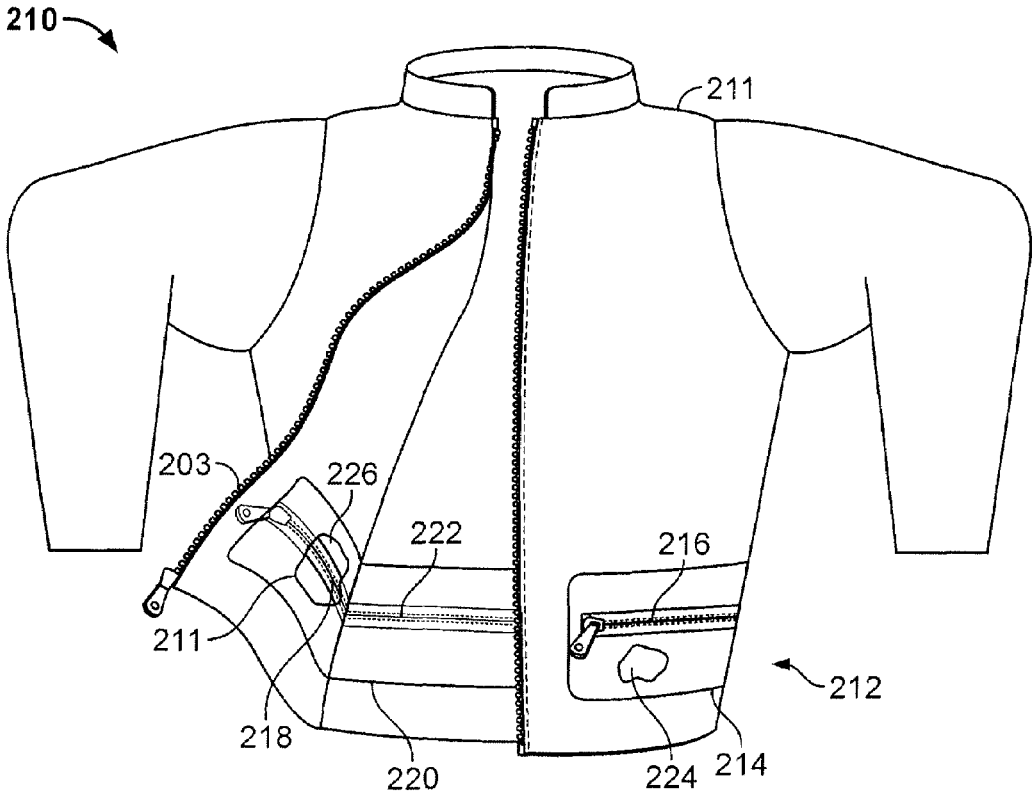
FIG. 14 is a garment having a full-length front zipper and a further embodiment of the dual access cargo system of the present invention.

Referring to FIG. 14, a garment 210 having a full-length frontal garment zipper 203 extending downwardly from the neckline of garment 210 for opening the front of garment 210 for wearer access, is provided for use with a dual access cargo system 212. Cargo system 212 includes a first access device 216 affixed to a first material portion 214 that is further affixed to the outer surface of shell 211 for defining a first chamber 224 for receiving an object as previously discussed. A second access device 218 is affixed to shell 211 providing selective access to first chamber 224 through shell 211. Similarly, a second material portion 220 is affixed to the inner surface of shell 211 having a third access device 222 for providing access to a second chamber 226 defined by second material portion 220 and an inner surface of shell 211. The conversion from garment mode to fanny pack mode is substantially similar to the conversion process as previously discussed. Cargo system 212 is compatible with access devices installed in garment 210, so long as second material portion 220 and third access device 222 are contiguous for receiving the entire garment shell 211 in inverted second chamber 226' (not shown) in fanny pack mode. Alternately, first material portion 214 and first access device 216 must be contiguous if shell 211 is entirely directed through the open first access device 216 that is affixed to first material portion 214 in fanny pack mode as previously discussed. While depicted in FIG. 14 as proceeding in a horizontal orientation, it is appreciated that so long as first material portion 214 and second material portion 220 sufficiently overlap to operate as discussed, and the inverted chamber that is to receive shell 211 in fanny pack mode, as previously discussed, is contiguous, the material portions 214, 220 may have any orientation with respect to the garment.

Figure 15:
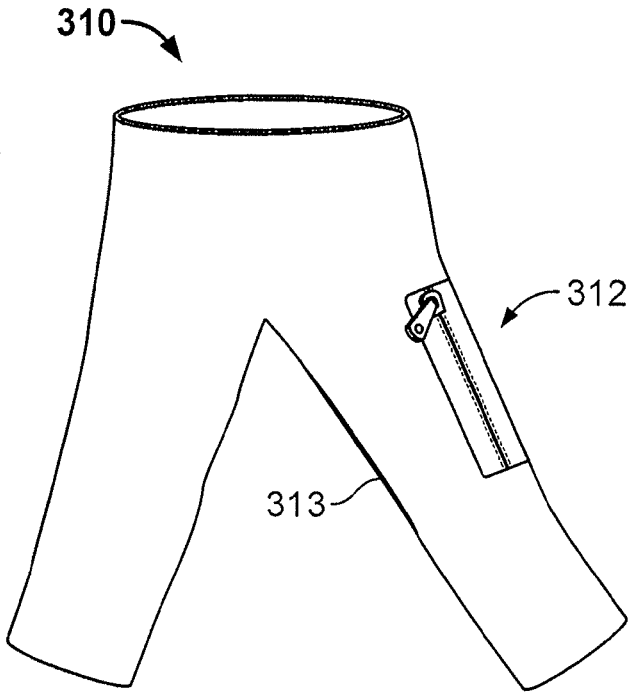
FIG. 15 is a different garment embodiment including the dual access cargo system of the present invention.

Referring to FIG. 15, a garment 310, such as a pair of pants, is compatible with a dual access cargo system 312 that functions substantially similar as previously discussed. Optionally, an access device 313 is provided so that prior to the conversion process from garment mode to fanny pack mode, the cargo system 312 is directed through the open access device 313, simplifying the conversion process, which then occurs substantially similar as previously discussed. Stated another way, cargo system 312 may be oriented in virtually any position along a garment so long as a second material portion that is affixed to an inside surface of the garment in garment mode may be directly accessible or exposed when converted to fanny pack mode.

Figure 16:
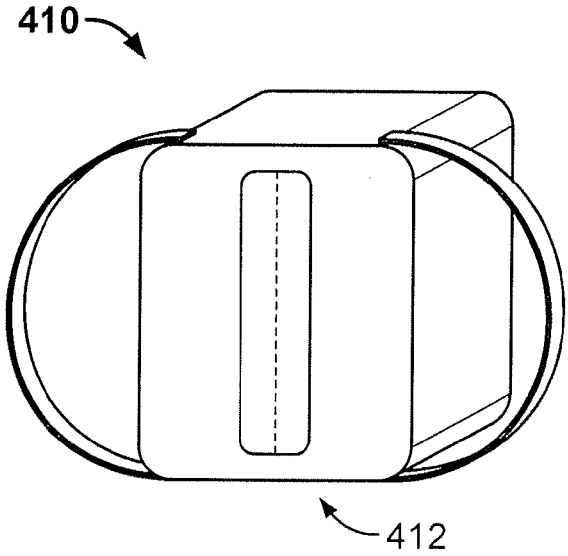
FIG. 16 is a convertible flexible container including the dual access cargo system of the present invention.

Referring to FIG. 16, a large flexible container 410, such as a backpack, may also be configured for use with a dual access cargo system 412. For example, mountain climbers, especially the lead climber, typically use backpacks to dispense rope for use by subsequent climbers. Upon either dispensing all the rope from the backpack or reaching the summit of the climb and then removing the remaining rope from the backpack, the backpack, originally filled with rope, is emptied, becoming sufficiently light to no longer warrant being carried on the wearer's back. The backpack 410 may then be converted to a fanny pack with dual access cargo capability as previously discussed for much more convenient transport. Stated another way, the present invention permits conversion of a large, flexible container to a smaller container (fanny pack) while permitting dual access capability.

One having skill in the art understands that although a preferred embodiment discloses affixing a first material portion to an outer surface of a garment shell and a second material portion affixed to an inner surface of a garment shell, it is also possible to locate both the first and second material portion together affixed to the outside surface of a garment shell or both first and second material portions affixed to the inside surface of the garment shell without deviating from the present invention. Further, while the access device exposed in a preferred embodiment is a zipper, it is understood that any type of fastening arrangement that provides access from either side of the access device, including, but not limited to, Velcro®, overlapping fabric that is buttoned, hooked or otherwise snapped or fastened together, or any other fastening devices that are compatible with fabric may also be used. It is also understood that when using zippers, two-way zippers may be required.

Although jackets are disclosed in a preferred embodiment, in addition to pants, any style or configuration of outerwear, such as hats, or bib overalls, may be used with the cargo system of the present invention. That is, upper body wear, lower body wear, or any combination thereof may be used. Additionally, a flexible container may also be used.

Although a preferred embodiment of the present invention contemplates a garment having a single layer or shell, it is contemplated that multiple layers may be utilized so that separate material portions are not required, the confines of the chambers used in the cargo system of the present invention being defined by stitching or adhesive or other form or methods of joining the multiple layers of garment material to form compartments as previously discussed.

Further, it is contemplated that a plurality of dual access cargo systems may be employed in a single garment, so long as each is capable of functioning as intended. Additionally, although the present invention discloses two adjacent chambers, it is contemplated that any reasonable number of aligned chambers may be employed with the cargo system of the present invention so long as it functions as discussed.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A convertible garment comprising:

a garment portion for being worn by a user and having a shell with an outside surface and an inside surface, the shell including a shell opening providing access through the shell, the shell having an access device for selectively opening and closing the shell opening;

at least one first material portion affixed to the outside surface of the shell and disposed over the shell opening, the shell and the at least one first material portion defining a first chamber for holding an object therein, the first chamber including a first chamber opening providing access through the at least one first material portion, the first chamber having a first access device for selectively closing and opening the first chamber opening, and the shell opening providing access to the first chamber through the shell;

a second material portion affixed to the inside surface of the shell and disposed over the shell opening, the shell and second material portion defining a second chamber sized to enclose at least the garment portion, the second chamber including a second chamber opening providing access through the second material portion, the second chamber having a second access device for selectively opening and closing the second chamber opening; and wherein upon turning the second chamber inside out and receiving the garment portion within the second chamber to form a duffel, an object enclosed in the first chamber being accessible from exterior of the duffel.

2. The convertible garment of claim 1 wherein the first chamber is sized to enclose at least the garment portion, wherein upon turning the first chamber inside out and receiving the garment portion within the first chamber to form a duffel, an object enclosed in the second chamber is accessible from exterior of the duffel.

3. The convertible garment of claim 2 further comprising a carrying means secured to the first chamber for carrying the garment as a duffel.

4. The convertible garment of claim 1 further comprising a carrying means secured to the second chamber for carrying the garment as a duffel.

5. The convertible garment of claim 1 wherein when the shell opening, the first chamber opening and the second chamber opening are open, the first chamber and the second chamber are in communication and accessible from interior and exterior of the shell.

6. The convertible garment of claim 1 wherein upon turning the second chamber inside out and receiving the garment portion within the second chamber to form a duffel, an object enclosed in the first chamber being accessible by sufficiently actuating the access device to open the shell opening.

7. The convertible garment of claim 6 wherein upon turning the second chamber inside out and receiving the garment portion within the second chamber to form a duffel, an object enclosed in the first chamber being accessible by sufficiently actuating the second access device to open the second chamber, and opening and sufficiently actuating the first access device to open the first chamber opening.

8. The convertible garment of claim 2 wherein upon turning the first chamber inside out and receiving the garment portion within the first chamber to form a duffel, an object enclosed in the second chamber is accessible by sufficiently actuating the access device to open the shell opening.

9. The convertible garment of claim 1 wherein the garment portion is in the form of upper body wear.

10. The convertible garment of claim 9 wherein the upper body wear is in the form of a jacket.

11. The convertible garment of claim 1 wherein the garment portion is in the form of lower body wear.

12. The convertible garment of claim 11 wherein the lower body wear is in the form of pants.

13. The convertible garment of claim 1 wherein the garment portion is in the form of headwear.

14. The convertible garment of claim 1 wherein the garment portion is in the form of a combination of upper and lower body wear.

15. The convertible garment of claim 1 wherein the access device, the first access device and the second access device are selected from the group consisting of zippers, velcro® and buttons.

16. The convertible garment of claim 1 wherein the garment portion includes the shell, the at least one first material portion and the second material portion each forming a layer of the garment portion.

17. The convertible garment of claim 1 wherein the shell and the at least one first material portion, and the shell and the second material portion are each joined together by the group consisting of thread, adhesive and fasteners.

18. The convertible garment of claim 1 wherein the at least one first material portion defines a plurality of first chambers for each holding an object therein, the plurality of first chambers each including a first chamber opening providing access through each of the at least one first material portion, each first chamber opening having a first access device for selectively closing and opening the first chamber opening, the shell having at least one shell opening providing access to each of the plurality of first chambers.

19. A convertible garment, comprising:

a garment portion for being worn by a user and having a shell, the shell including a shell opening providing access through the shell, the shell having an access device for selectively opening and closing the shell opening;

a first material portion affixed to a surface of the shell and disposed over the opening, the shell and first material portion defining a first chamber for holding an object therein, the first chamber including a first chamber opening providing access through the first material portion, the first chamber having a first access device for selectively closing and opening the first chamber opening, and the shell opening providing access to the first chamber through the shell;

a second material portion affixed at least partially disposed over the first material portion and disposed over the first opening in the first material portion, the first material portion and the second material portion defining a second chamber sized to enclose at least the garment portion, the second chamber including a second chamber opening providing access through the second material portion having a second access device for selectively opening and closing the second chamber opening; and wherein upon turning the second chamber outside out and receiving the garment portion within the second chamber to form a duffel, an object enclosed in the first chamber is accessible from exterior of the duffel.

20. The convertible garment of claim 19 wherein the first chamber is sized to enclose at least the garment portion, wherein upon turning the first chamber inside out to form a duffel by receiving the garment portion within the first chamber, an object enclosed in the second chamber is accessible by sufficiently actuating the access device to open the shell opening.

21. The convertible garment of claim 19 wherein when the shell opening, the first chamber opening and the second chamber opening are open, the first chamber and the second chamber are in communication and accessible from interior and exterior of the shell.

22. The convertible garment of claim 19 wherein upon turning the second chamber outside out and receiving the garment portion within the second chamber to form a duffel, an object enclosed in the first chamber is accessible by sufficiently actuating the first access device to open the first opening.

23. The convertible garment of claim 19 wherein the first material portion is affixed to an inside surface of the shell.

24. The convertible garment of claim 19 wherein the first material portion is affixed to an outside surface of the shell.

25. A method for incorporating a dual access cargo system for use with a convertible garment portion, the steps comprising:

providing a garment portion for being worn by a user and having a shell with an outside surface and an inside surface;

forming an opening in the shell to provide access through the shell;

affixing an access device to the shell opening for selectively opening and closing the shell opening;

affixing a first material portion to the inside surface of the shell and disposed over the shell opening, the shell and first material portion defining a first chamber for holding an object therein, the first chamber including a first chamber opening providing access through the first material portion having a first access device for selectively closing and opening the first chamber opening, the shell opening providing access to the first chamber through the shell; and affixing a second material portion at least partially disposed over the first material portion and disposed over the first opening in the first material portion, the first material portion and second material portion defining a second chamber sized to enclose at least the garment portion, the second chamber including a second chamber opening providing access through the second material portion having a second access device for selectively opening and closing the second chamber opening, wherein upon turning the second chamber outside out and receiving the garment portion within the second chamber to form a duffel, the object enclosed in the first chamber is accessible from exterior of the duffel.

* * * * *